US009285749B2

(12) United States Patent
Hirose

(10) Patent No.: US 9,285,749 B2
(45) Date of Patent: Mar. 15, 2016

(54) IMAGE FORMING APPARATUS WHICH RECEIVES AN INSTRUCTION TO TAKE OUT SHEETS STORED IN A STORAGE PORTION

(71) Applicant: CANON KABUSHIKI KAISHA, Tokyo (JP)

(72) Inventor: Takafumi Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/486,709

(22) Filed: Sep. 15, 2014

(65) Prior Publication Data

US 2015/0078797 A1 Mar. 19, 2015

(30) Foreign Application Priority Data

Sep. 17, 2013 (JP) ..... 2013-191853
Jul. 24, 2014 (JP) ..... 2014-150777

(51) Int. Cl.

| | |
|---|---|
| ***G03G 15/00*** | (2006.01) |
| ***B41J 13/10*** | (2006.01) |
| ***B65H 31/24*** | (2006.01) |
| ***B65H 31/30*** | (2006.01) |

(52) U.S. Cl.

CPC ..... *G03G 15/6552* (2013.01); *B41J 13/106* (2013.01); *B65H 31/24* (2013.01); *B65H 31/3081* (2013.01); *G03G 15/6538* (2013.01); *B65H 2405/332* (2013.01); *B65H 2511/412* (2013.01); *G03G 15/6547* (2013.01); *G03G 2215/00911* (2013.01)

(58) Field of Classification Search

CPC ..... G03G 15/6552; G03G 15/6547; G03G 15/6538; G03G 2215/00911; B65H 39/11; B65H 31/24; B65H 31/26; B65H 31/3081; B65H 83/00; B65H 2405/332; B65H 2407/133; B65H 2511/412; B65H 2402/443; B41J 13/106

See application file for complete search history.

(56) References Cited

U.S. PATENT DOCUMENTS

2006/0261543 A1* 11/2006 Miyake et al. ..... 271/292

FOREIGN PATENT DOCUMENTS

| | | | | |
|---|---|---|---|---|
| JP | 02-233469 A | | 9/1990 | |
| JP | 07-125909 A | | 5/1995 | |
| JP | 08-59066 A | | 3/1996 | |
| JP | 2776873 | * | 7/1998 | ..... B65H 39/11 |
| JP | 2004-338295 A | | 12/2004 | |

OTHER PUBLICATIONS

Machine translation of JP H07-125909 to Aihara published on May 16, 1995.*

* cited by examiner

*Primary Examiner* — Blake A Tankersley
(74) *Attorney, Agent, or Firm* — Canon USA, Inc. IP Division

(57) ABSTRACT

An image forming apparatus that executes image forming processing and stores sheets in a sheet storage location of the image forming apparatus even when the image forming processing results in needing to store more sheets that the amount of sheets storable in the sheet storage location.

7 Claims, 12 Drawing Sheets

IMAGE FORMING APPARATUS WHICH RECEIVES AN INSTRUCTION TO TAKE OUT SHEETS STORED IN A STORAGE PORTION

BACKGROUND

1. Field

Aspects of the present invention generally relate to an image forming apparatus which includes a storage portion for temporarily storing a sheet on which an image is formed within the image forming apparatus.

2. Description of the Related Art

Conventionally, there has been an image forming apparatus such as a copying machine or a printer which includes a storage portion for temporarily storing sheets within the apparatus so that a user can receive only the user's sheets while the user's sheets on which images are formed are prevented from being seen by other users.

Japanese Patent Application Laid-Open No. 7-125909 discusses an image forming apparatus which includes a plurality of storage portions for temporarily storing sheets on which images are formed within the apparatus in addition to a normal discharge tray disposed on an upper surface of the apparatus main unit shared by a plurality of users. The sheets stored in the storage portions cannot be seen from the exterior of the apparatus. Further, in the above-described image forming apparatus, a plurality of the storage portions is allocated to the users so that the sheets are sorted into different storage portions for the respective users. In order to receive the sheets, the user gives a discharge instruction to the image forming apparatus, so that the sheets stored in the storage portion corresponding to the user who gives that discharge instruction are discharged to the exterior of the apparatus. With this operation, the user can receive only the user's sheets while the user's sheets on which images are formed are prevented from being seen by other users.

In the configuration in which the storage portions are disposed within the apparatus as discussed in Japanese Patent Application Laid-Open No. 7-125909, the number of sheets storable in the storage portion has an upper limit. Therefore, in Japanese Patent Application Laid-Open No. 7-125909, when the user instructs the image forming apparatus to store the sheets more than the upper limit of the storage portion, the sheets are discharged to a normal discharge tray, or the image forming processing with respect to the sheets is not executed while the user is given a message indicating that the sheets cannot be stored in the storage portion. However, if the sheets are discharged to the normal discharge tray, it is not possible to achieve the original purpose of preventing the sheets on which images are formed from being seen by other users, and not only that, there is a problem in that the user's sheets and other user's sheets are mixed with each other. Moreover, productivity thereof will be naturally lowered if the image forming processing is stopped.

SUMMARY

Aspects of the present invention are generally directed to an image forming apparatus capable of suppressing lowering of confidentiality and productivity by continuously executing image forming processing and stores sheets in a storage portion even in a case where the image forming apparatus is instructed to execute the image forming processing to store more sheets than the amount of sheets storable in the storage portion.

According to an aspect of the present invention, an image forming apparatus includes a storage portion configured to store a sheet on which an image is formed, inside a main body of the image forming apparatus, a conveyance unit configured to convey the sheet on which the image is formed, to the storage portion, an opening configured to expose the sheet stored in the storage portion outside the main body of the image forming apparatus, and a moving unit configured to move the sheet and stop the sheet in an exposed state in which a part of the sheet is exposed outside the main body of the image forming apparatus through the opening, wherein, in a case where the image forming apparatus receives a first instruction to convey a first number of sheets, which is more than a storable number in the storage portion, to the storage portion, the conveyance unit starts conveying a second number of sheets, which is at least one and less than the storable number in the storage portion, and in a case where the main body of the image forming apparatus receives a second instruction to take out the sheets stored in the storage portion, the moving unit moves the second number of sheets stored in the storage portion, and stops the second number of the sheets in the exposed state.

Further features of the present disclosure will become apparent from the following description of exemplary embodiments with reference to the attached drawings.

DESCRIPTION OF THE EMBODIMENTS

An exemplary embodiment of the present invention will be described in detail with reference to the drawings below.

<Configuration Diagram of Image Forming Apparatus>

Figure 1:
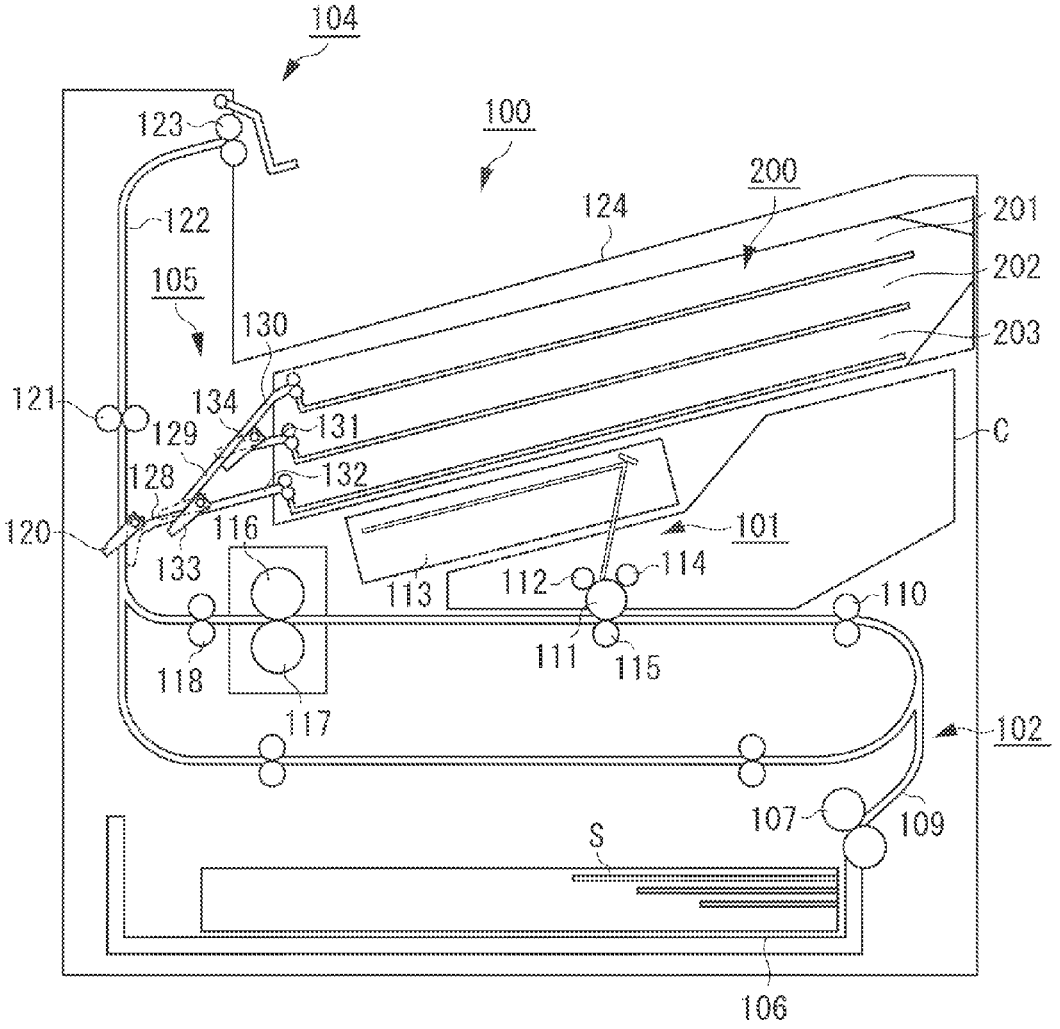
FIG. 1 is a diagram illustrating a configuration of an image forming apparatus according to an exemplary embodiment.

FIG. 1 is a diagram illustrating a configuration of an image forming apparatus provided with a storage portion according to a first exemplary embodiment. In the present exemplary embodiment, a laser beam printer is taken as an example of the image forming apparatus.

An image forming apparatus 100 includes an image forming unit 101, a supply unit 102 for supplying sheets S to the image forming unit 101, and a discharge unit 104 for discharging the sheets S on which images are formed by the image forming unit 101. For example, a sheet of paper, an overhead projector (OHP) sheet, and fabric are included in the sheets S. Further, a storage device 200 which includes a plurality of storage portions 201 to 203 for temporarily storing the sheets S on which images are formed in the apparatus is disposed on the upper side of the image forming unit 101. Furthermore, the image forming apparatus 100 includes a conveyance unit 105 for conveying the sheets S on which images are formed to the storage device 200.

The image forming unit 101 includes a photosensitive drum 111 which rotates in a clockwise (CW) direction in FIG. 1, a charging roller 112 for charging a surface of the photosensitive drum 111, and an exposure device 113 for forming an electrostatic latent image by irradiating the photosensitive drum 111 with light. Further, the image forming unit 101 includes a development device 114 for forming a toner image on the photosensitive drum 111 by adhering toner to the electrostatic latent image, and a transfer roller 115 for transferring the toner image onto the sheet S conveyed thereto. Furthermore, the image forming unit 101 includes a fixing roller 116, a pressure roller which makes contact with the fixing roller 116 on the lower side thereof, and a fixing discharge roller 118, so that the toner image transferred to the sheet S is fixed on the sheet S. The image forming unit 101 forms a toner image on the sheet S through the above-described image forming processing. In the image forming apparatus 100 according to the present exemplary embodiment, the photosensitive drum 111, the charging roller 112, the development device 114, and a toner storage portion (not illustrated) for storing toner are integrated as a cartridge C, so as to be detachable from the image forming apparatus 100. The user can replace the cartridge C when the toner is used up. In addition, the present disclosure is applicable not only to the above-described cartridge-type image forming apparatus 100 but also to the image forming apparatus 100 which does not require replacement of members, in which the members such as the photosensitive drum 111, the charging roller 112, and the development device 114 are mounted thereon.

The supply unit 102 includes a supply cassette 106 in which the plurality of sheets S used for the image formation is stacked and stored, a supply roller 107, a conveyance guide 109, and a registration roller 110.

The discharge unit 104 includes a first switching member 120, a conveyance roller 121, a discharge guide 122, a discharge roller 123, and a discharge tray 124. In FIG. 1, a position of the first switching member 120 can be switched between a position indicated by a solid line, where the sheet S after the image formation is moved toward the storage device 200, and a position indicated by a dashed line, where the sheet S after the image formation is moved toward the discharge tray 124 by an actuator (not illustrated). The discharge tray 124 is disposed on the upper surface of the image forming apparatus 100 so that a plurality of users can share the discharge tray 124. The sheet S is discharged to the discharge tray 124, with a plane (surface) thereof on which an image is formed facing downward (face-down state).

The conveyance unit 105 includes a second switching member 133 and a third switching member 134 for switching a conveyance destination of the sheet S, and conveyance guides 128 to 132 for guiding the sheet S to the respective storage portions 201 to 203. In FIG. 1, positions of the second switching member 133 and the third switching member 134 can be switched between positions indicated by solid lines and positions indicated by dashed lines by actuators (not illustrated). For example, when the sheet S is conveyed to the first storage portion 201, the second switching member 133 and the third switching member 134 are respectively positioned at the positions indicated by the solid lines in FIG. 1. The sheet S passes through the conveyance guides 128, 129, and 130 in this order, so as to be conveyed to the first storage portion 201. Further, when the sheet S is conveyed to the second storage portion 202, only the position of the third switching member 134 is switched to the position indicated by the dashed line. At this time, the sheet S passes through the conveyance guides 128, 129, and 131 in this order, so as to be conveyed to the second storage portion 202. Similar to the sheets S discharged on the discharge tray 124, the sheets S are also stored in the storage portions 201 to 203 in a face-down state.

<Configuration Diagram of Storage Device>

Figure 2:
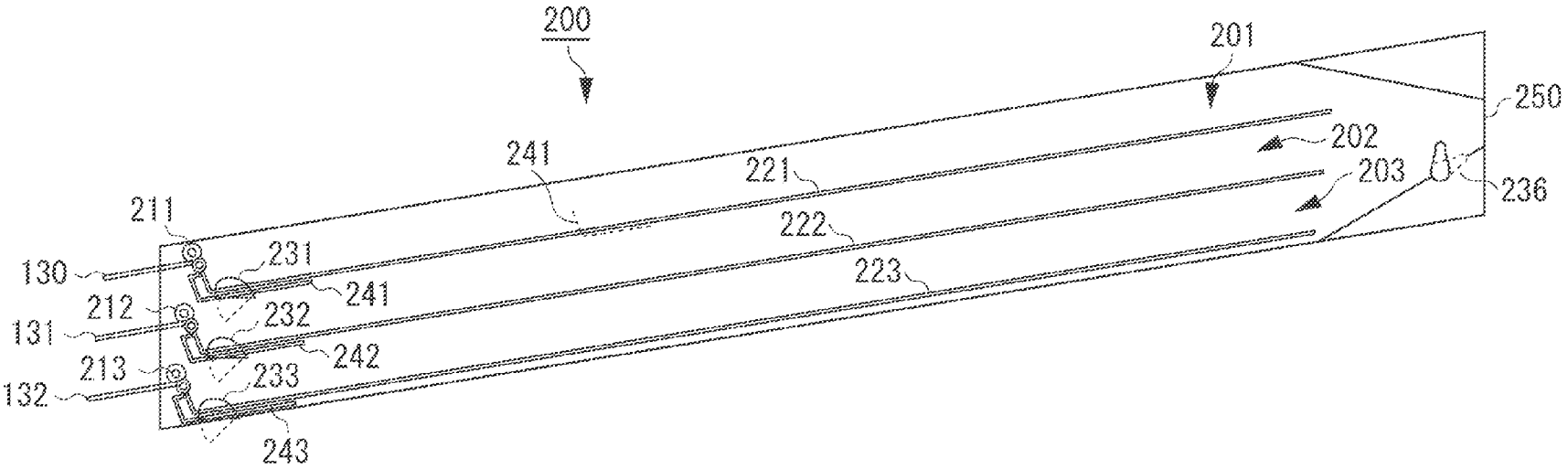
FIG. 2 is a diagram illustrating a configuration of a storage device according to the exemplary embodiment.

FIG. 2 is a diagram illustrating a configuration of the storage device 200. In the storage device 200 according to the present exemplary embodiment, a plurality of stages of storage portions 201 to 203 are stacked and arranged in a vertical direction. Because configurations of the storage portions 201 to 203 are identical to each other, a configuration of the first storage portion 201 will be described.

The first storage portion 201 includes a conveyance roller 211 for conveying the sheets S, a stacking tray 221 for temporarily stacking and storing the sheets S, and a sheet presence-absence sensor 231 for detecting whether the sheets S are stacked on the stacking tray 221. Further, the first storage portion 201 includes a moving unit 241 which pressurizes a trailing end of the stored sheets S (an end portion on the upstream side in the sheets S conveyance direction) and exposes a leading end of the stored sheets S (an end portion on the downstream side in the sheets S conveyance direction) to the exterior of the image forming apparatus 100. The moving unit 241 moves the sheets S up to a position where the user can receive the sheets S, which is a position where the leading end of the sheets S passes through the opening 250. Through these operations, a part of the sheets S can be exposed to the exterior of the apparatus by a predetermined amount. In addition, in the present exemplary embodiment, the predetermined amount of the sheets S exposed to the exterior of the apparatus is set to 3 cm. This predetermined amount is merely one example, and any amount can be set thereto as long as the user can hold the exposed sheets S while the sheets S do not warp remarkably.

The stacking tray 221 has such a length that the leading end of the sheets S is not exposed from the opening 250 even if a maximum size of the sheets S storable in the first storage portion 201 are stacked thereon. The sheet presence-absence sensor 231 is turned on when the sheets S are stacked on the stacking tray 221 and the sheet presence-absence sensor 231 is inclined to the position indicated by the dashed line. The sheet presence-absence sensor 231 is turned off when the sheets S are moved by the moving unit 241 and the sheet presence-absence sensor 231 returns to the position indicated by the solid line. Further, the opening sensor 236 is turned on when the leading end of the sheets S moved thereby inclines the opening sensor 236 arranged in the vicinity of the opening 250 to the position indicated by the dashed line. When the sheets S exposed to the exterior of the apparatus are removed and the opening sensor 236 returns to the position indicated by the solid line, the opening sensor 236 is turned off. When the sheets S are sequentially conveyed to the first storage portion 201, the moving unit 241 is positioned at a stacking position indicated by a solid line. This stacking position illustrates a state where the moving unit 241 is positioned on the leftmost side in FIG. 2. On the other hand, when the stored sheets S are to be exposed, the moving unit 241 moves to an exposing position indicated by a dashed line by moving toward the opening 250 in the sheet S conveyance direction. This exposing position illustrates a state where the moving unit 241 moves in a direction of the opening 250 in order to expose the leading end of the sheets S. A moving amount of the moving unit 241 is determined according to an exposing amount of the sheets S and a size of the sheets S in the conveyance direction thereof (the moving amount thereof is determined by a storage device control unit 304 described below).

Figure 3:
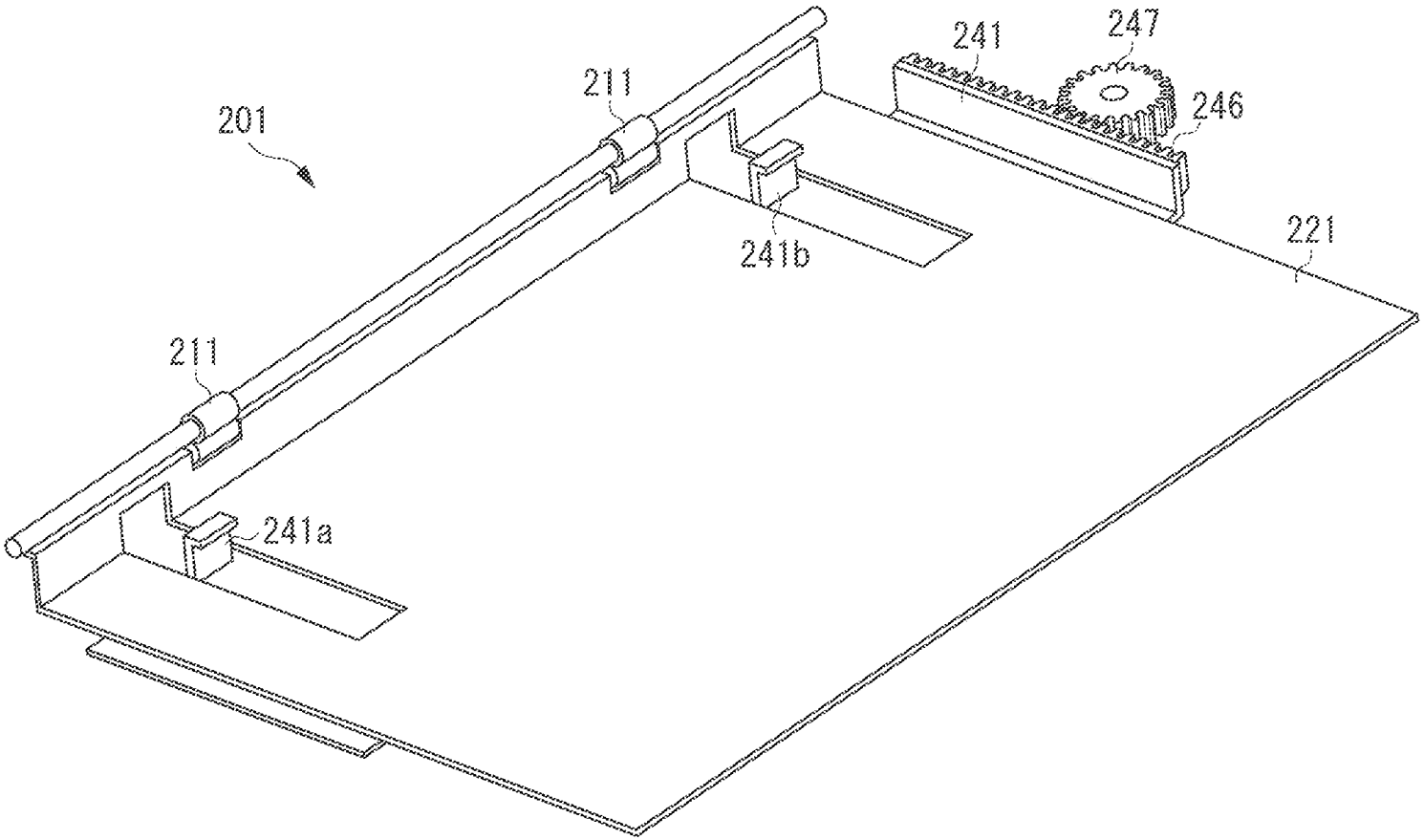
FIG. 3 is a perspective view of a storage portion according to the exemplary embodiment.

FIG. 3 is a perspective view of the storage portion 201. In FIG. 3, the moving unit 241 is positioned between the stacking position and the exposing position. The moving unit 241 includes two sheet trailing end pressurizing portions 241*a* and 241*b*, arranged in the sheet S width direction. Further, the moving unit 241 integrally includes a rack 246. The rack 246 engages with a pinion 247, and the pinion 247 is connected to the actuator serving as a driving unit which is not illustrated in FIG. 3. The moving unit 241 can reciprocally move between the stacking position and the exposing position when the actuator is driven in a forward direction and a backward direction.

<Block Diagram of Control Unit and Functional Configuration>

Figure 4:
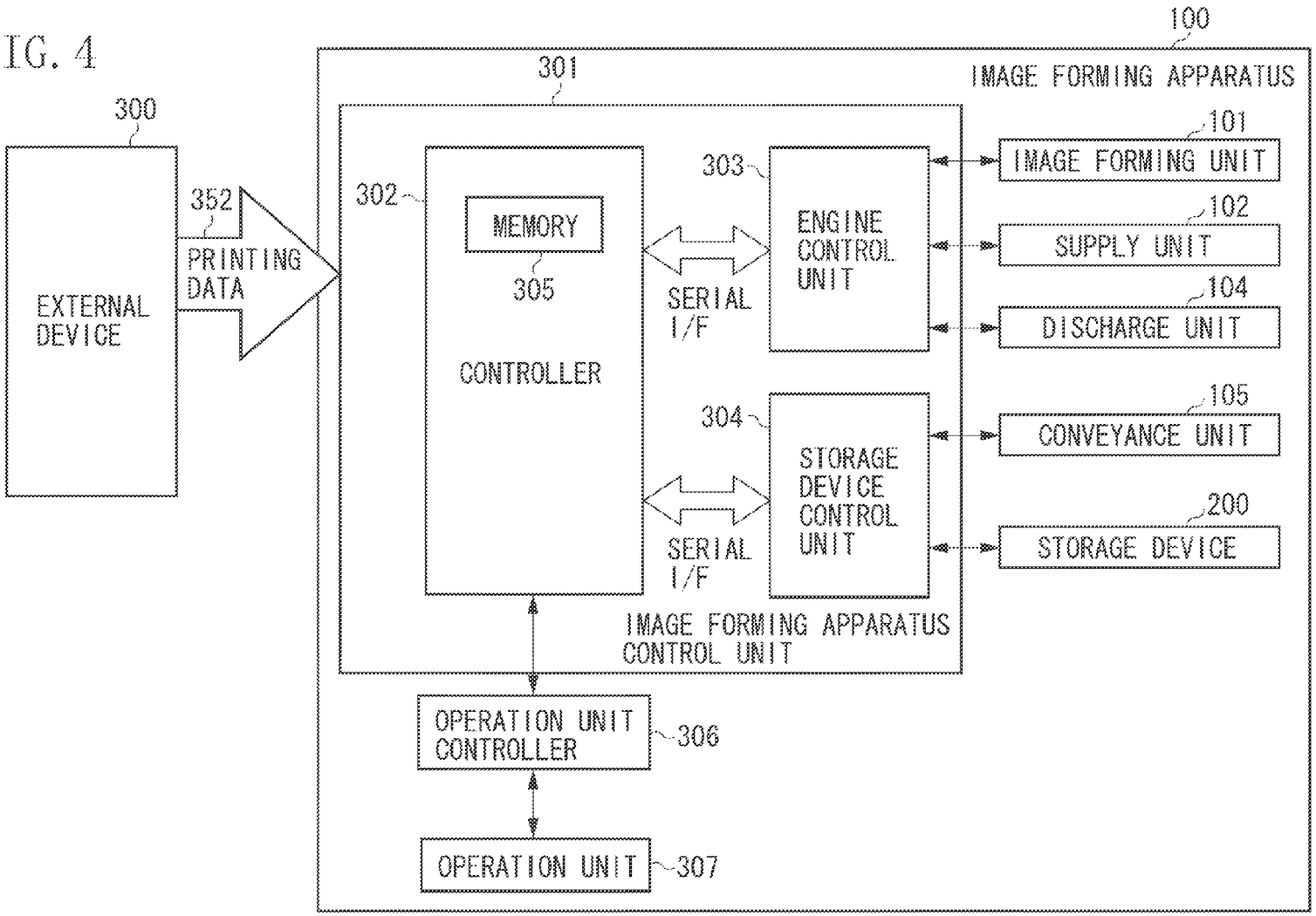
FIG. 4 is a block diagram illustrating a control unit and a functional configuration of the image forming apparatus according to the exemplary embodiment.

FIG. 4 is a block diagram illustrating a control unit and a functional configuration according to the present exemplary embodiment. The image forming apparatus 100 includes an image forming apparatus control unit 301 serving as a control unit. The image forming apparatus control unit 301 includes a controller 302, an engine control unit 303, and a storage device control unit 304.

The controller 302 receives printing data 352 by communicating with an external device 300 such as a host computer. The received printing data 352 is stored in a memory 305 such as a random access memory (RAM). The controller 302 creates a printing condition by analyzing the printing data 352 stored in the memory 305. For example, the printing condition is the information such as the number of supplied sheets S, a discharge destination of the sheets S on which images are formed, or the printing density of the images. Then, the controller 302 specifies the printing condition created from the printing data 352 to the engine control unit 303 through a serial interface (I/F). The engine control unit 303 controls each mechanism according to the printing condition received from the controller 302. More specifically, the engine control unit 303 controls the image forming unit 101 to form images on the sheets S, and controls the supply unit 102 and the discharge unit 104 to supply or discharge the sheets S.

Further, the controller 302 creates a storage condition and a discharge condition of the storage portions 201 to 203 by analyzing the printing data 352 stored in the memory 305. Then, the controller 302 specifies the storage condition and the discharge condition created from the printing data 352 to the storage device control unit 304 through a serial I/F. The storage condition is the information such as a tray of the storage device 200 serving as a storage destination of the sheets S on which images are formed, or the number of sheets S to be stored therein. Further, the discharge condition is the information such as an amount of sheets S exposed to the exterior from the opening 250. The storage device control unit 304 controls each mechanism according to the storage condition and the discharge condition received from the controller 302. More specifically, the storage device control unit 304 controls the conveyance unit 105 to convey the sheets S on which images are formed to the storage portions 201 to 203, and controls the storage device 200 including the moving unit 241 to move the sheets S stored in the storage portions 201 to 203 to the opening 250. Further, the operation unit controller 306 executes control processing for notifying the controller 302 of various settings and a discharge instruction input by the user through the operation unit 307.

<Details of Storage Device Control Unit>

Figure 5:
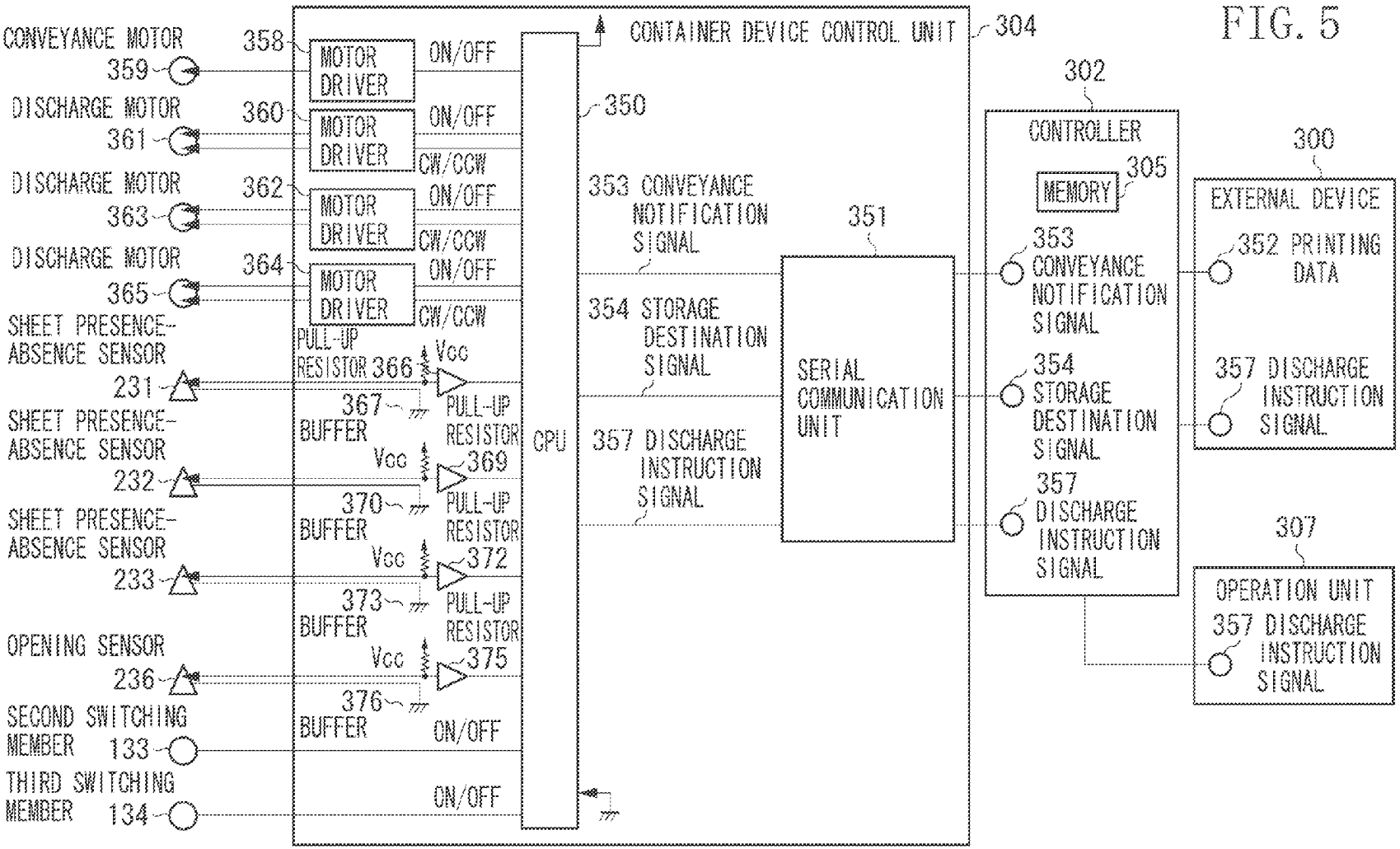
FIG. 5 is a detailed diagram of a storage device control unit according to the exemplary embodiment.

FIG. 5 is a detailed diagram of the storage device control unit 304 according to the present exemplary embodiment. The storage device control unit 304 includes a central processing unit (CPU) 350 and communicates with the controller 302 via a serial communication unit 351. The serial communication unit 351 connects the CPU 350 and the controller 302 with a plurality of signal lines. In the present exemplary embodiment, the serial communication unit 351 includes three signal lines for transmitting a conveyance notification signal 353, a storage destination signal 354, and a discharge instruction signal 357 described below.

Control processing for storing the sheet S in the storage device 200 will be described. When the printing data 352 is notified to the controller 302 through the external device 300, the controller 302 temporarily stores the printing data 352 in the memory 305. Thereafter, the controller 302 analyzes the stored printing data 352 and notifies the CPU 350 of the conveyance notification signal 353 and the storage destination signal 354 via the serial communication unit 351. Based on the notified signals, the CPU 350 controls each of the actuators described below, so as to convey the printed sheets S to each of the storage portions 201 to 203.

Next, control processing for exposing the sheets S from the storage device 200 will be described. When the user gives a discharge instruction of the sheets S stored in any of the storage portions 201 to 203 through the external device 300 or the operation unit 307, the discharge instruction signal 357 is notified to the controller 302. After determining the storage portion from which the sheets S are to be discharged, the controller 302 instructs the CPU 350 to discharge the sheets S from the corresponding storage portion by notifying the CPU 350 of the discharge instruction signal 357 via the serial communication unit 351. The CPU 350 controls each of the actuators described below so as to expose the sheets S stored in the notified storage portion to the exterior of the apparatus from the opening 250.

Next, each of the actuators connected to the CPU 350 will be described.

A motor driver 358 is connected to an output terminal of the CPU 350. The motor driver 358 drives a conveyance motor 359. When the conveyance motor 359 is rotated, the conveyance rollers 211, 212, and 213 rotate and convey the sheets S to each of the storage portions 201 to 203.

A motor driver 360 is connected to an output terminal of the CPU 350. The motor driver 360 drives a discharge motor 361. When the discharge motor 361 is rotated in a clockwise (CW) direction, the moving unit 241 of the first storage portion 201 moves toward the opening 250. When the discharge motor 361 is rotated in a counterclockwise (CCW) direction, the moving unit 241 of the first storage portion 201 moves in a direction opposite to the opening 250. Similarly, motor drivers 362 and 364 are connected to output terminals of the CPU 350 and respectively drive discharge motors 363 and 365. The discharge motor 363 drives a moving unit 242 of the second storage portion 202, whereas the discharge motor 365 drives a moving unit 243 of the third storage portion 203.

The sheet presence-absence sensor 231 inputs information indicating whether the sheets S are stored in the first storage portion 201 to the CPU 350 via a buffer 367 by using a pull-up resistor 366. Likewise, a sheet presence-absence sensor 232 inputs information indicating whether the sheets S are stored in the second storage portion 202 to the CPU 350, and a sheet presence-absence sensor 233 inputs information indicating whether the sheets S are stored in the third storage portion 203 to the CPU 350.

The opening sensor 236 inputs information indicating whether the sheets S are exposed to the exterior of the apparatus from the opening 250 to the CPU 350 via a buffer 367 by using a pull-up resistor 375.

The actuator for switching the second switching member 133 is connected to an output terminal of the CPU 350. When the actuator is ON, the second switching member 133 is switched so as to convey the sheets S in a direction of the conveyance guide 129. When the actuator is OFF, the second switching member 133 is switched so as to convey the sheets S in a direction of the conveyance guide 132. Similarly, the actuator for switching the third switching member 134 is connected to an output terminal of the CPU 350. When the actuator is ON, the third switching member 134 is switched so as to convey the sheets S in a direction of the conveyance guide 130, and when the actuator is OFF, the third switching member 134 is switched so as to convey the sheets S in a direction of the conveyance guide 131.

<Description on Operation of Storage Device>

Next, an operation of the storage device 200 will be described. In the present exemplary embodiment, when the sheets S are stored in the storage device 200, the sheets S are sorted to different storage portions according to a job number of the sheets S. Further, when the sheets S are exposed from the storage device 200, the sheets S of the user who gives a discharge instruction of the sheets S are exposed to the exterior of the apparatus from the opening 250. The user can give a discharge instruction by inputting a preset password to the external device 300 or the operation unit 307. Alternatively, the user can give a discharge instruction through user authentication by causing an identification (ID) card reading unit (not illustrated) disposed on the operation unit 307 to read the user's ID card. As described above, in the present exemplary embodiment, the actuators for driving the moving units 241 to 243 are separately provided on the storage portions 201 to 203. Accordingly, even in a case where the same user's sheets S are stored in a plurality of the storage portions, the user can collectively receive the sheets S by driving the respective actuators. Further, the job number of the sheets S and information of the user who instructs printing of the sheets S are stored in the memory 305 disposed on the controller 302. According to the discharge instruction from the user, the controller 302 refers to the memory 305 to specify the sheets S as a discharge target and instructs the storage device 200 to execute a discharge operation.

Figure 6A:
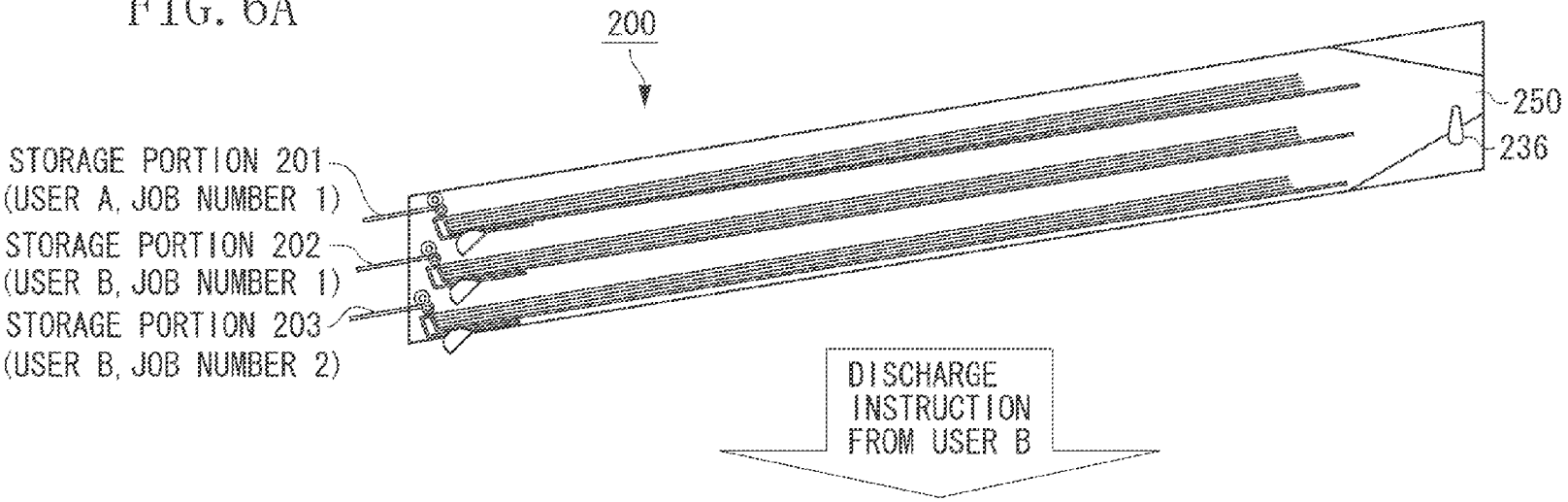
FIGS. 6A and 6B are diagrams illustrating a state where the sheets are exposed from the storage device according to the exemplary embodiment.
Figure 6B:
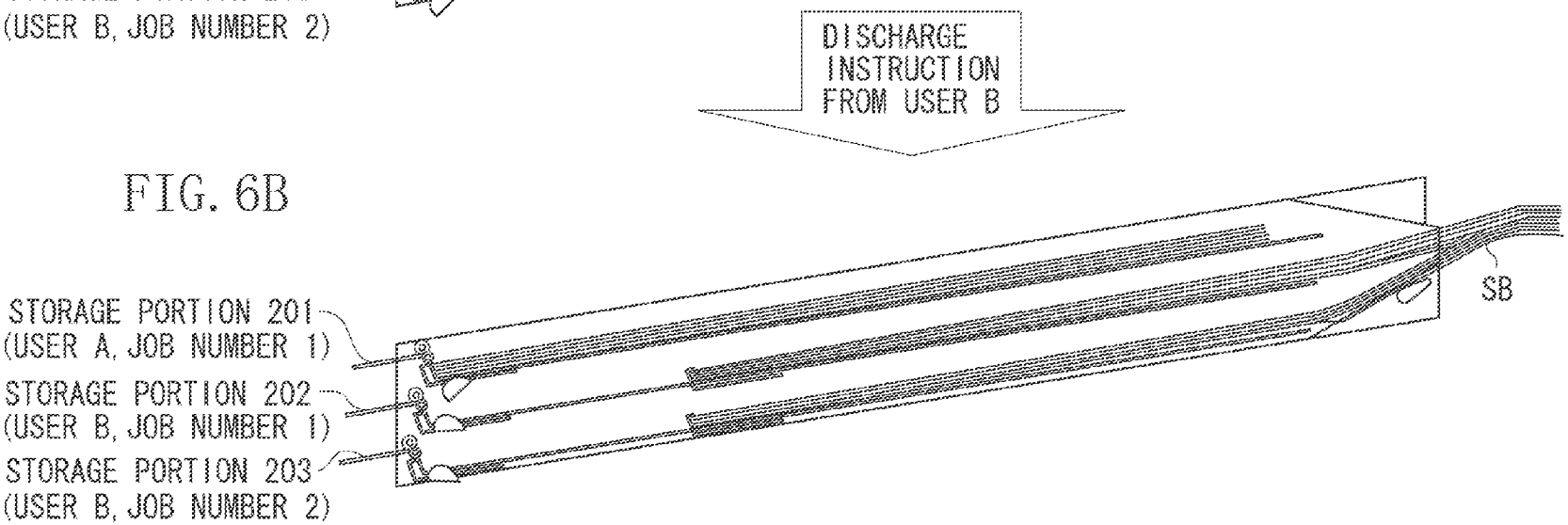

FIGS. 6A and 6B are diagrams illustrating operation examples of the storage device 200. In FIG. 6A, the sheets S of a user A are stored in the storage portion 201, whereas the sheets S of a user B are stored in the storage portions 202 and 203. Of the sheets S that the user B has instructed the printing operation, the sheets S having a job number 1 are stored in the storage portion 202 whereas the sheets S having a job number 2 are stored in the storage portion 203. In FIG. 6B, when the discharge instruction of the sheets S of the user B is given, the moving units 242 and 243 of the storage portions 202 and 203 move toward the opening 250 to expose a bundle of sheets SB from the opening 250.

Figure 7:
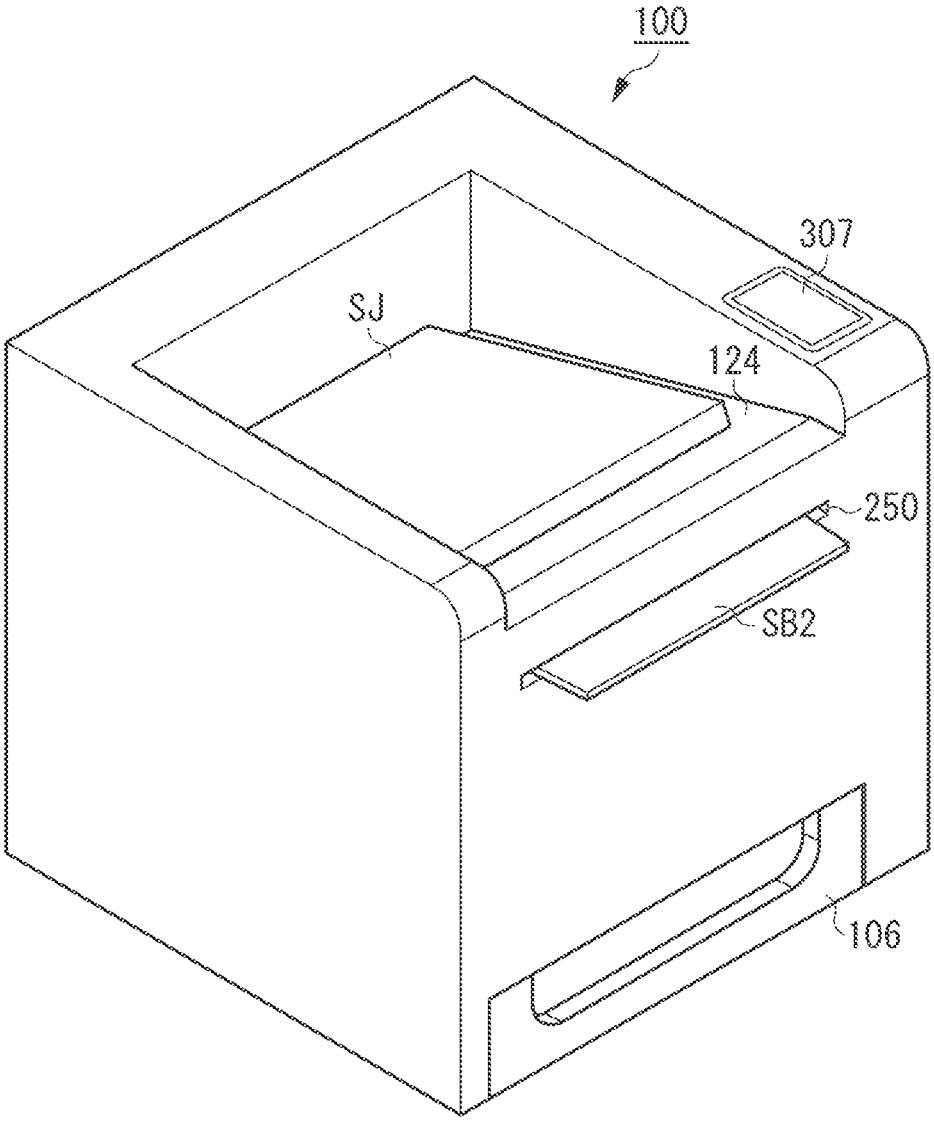
FIG. 7 is a perspective view illustrating a state where the sheets are exposed from the image forming apparatus according to the exemplary embodiment.

FIG. 7 is a perspective view of the image forming apparatus 100 in the above-described state. A bundle of printed sheets SJ printed by a plurality of users is stacked on the discharge tray 124, and a leading end SB2 of the bundle of the sheets SB exposed from the storage portions 202 and 203 is exposed from the opening 250. The user can receive the bundle of the sheets SB by holding and pulling out the leading end SB2 exposed to the exterior of the apparatus.

Further, in a case where the user gives an instruction for storing a number of sheets S more than the sheets S storable in one storage portion, the image forming apparatus 100 sorts the sheets S to different storage portions even if the same job number is assigned thereto. For example, in FIG. 6A, the sheets S of the user B having different job numbers are stored in the storage portions 202 and 203 respectively. If the number of sheets S having the job number 1 is greater than the maximum number of sheets S storable in the storage portion 202, the image forming apparatus 100 also sorts the sheets S having the job number 1 to the storage portion 203. However, in such a case, it is a prerequisite that the storage portion 203 does not store other sheets S.

The storage device 200 is enclosed on all sides thereof except for the opening 250 that exposes the stored sheets S. Accordingly, in a state where the sheets S are stored in the storage portions 201 to 203, the user cannot see the information printed on the sheets S stored therein. With this configuration, the information printed on the user's sheets S cannot be seen by other users, and thus the confidentiality of the information can be improved.

On the other hand, as a method for improving the confidentiality of the information, there is provided an image forming apparatus which starts image forming processing after executing user authentication by using an ID card. However, in comparison to the above image forming apparatus, because the image forming apparatus 100 according to the present exemplary embodiment simply exposes the sheets S on which the images have already been formed from the storage portions 201 to 203, the user can quickly receive the sheets S after executing the user authentication.

Furthermore, when the user gives a discharge instruction to the image forming apparatus 100, the user can only receive the user's sheets. With this configuration, the user does not have to look for the user's sheets from the discharge tray 124 where the user's sheets and other user's sheets are mixed and stacked thereon.

<Processing with Respect to an Instruction for Storing a Number of Sheets More than the Sheets Storable in a Plurality of Vacant Storage Portions.>

Figure 8A:
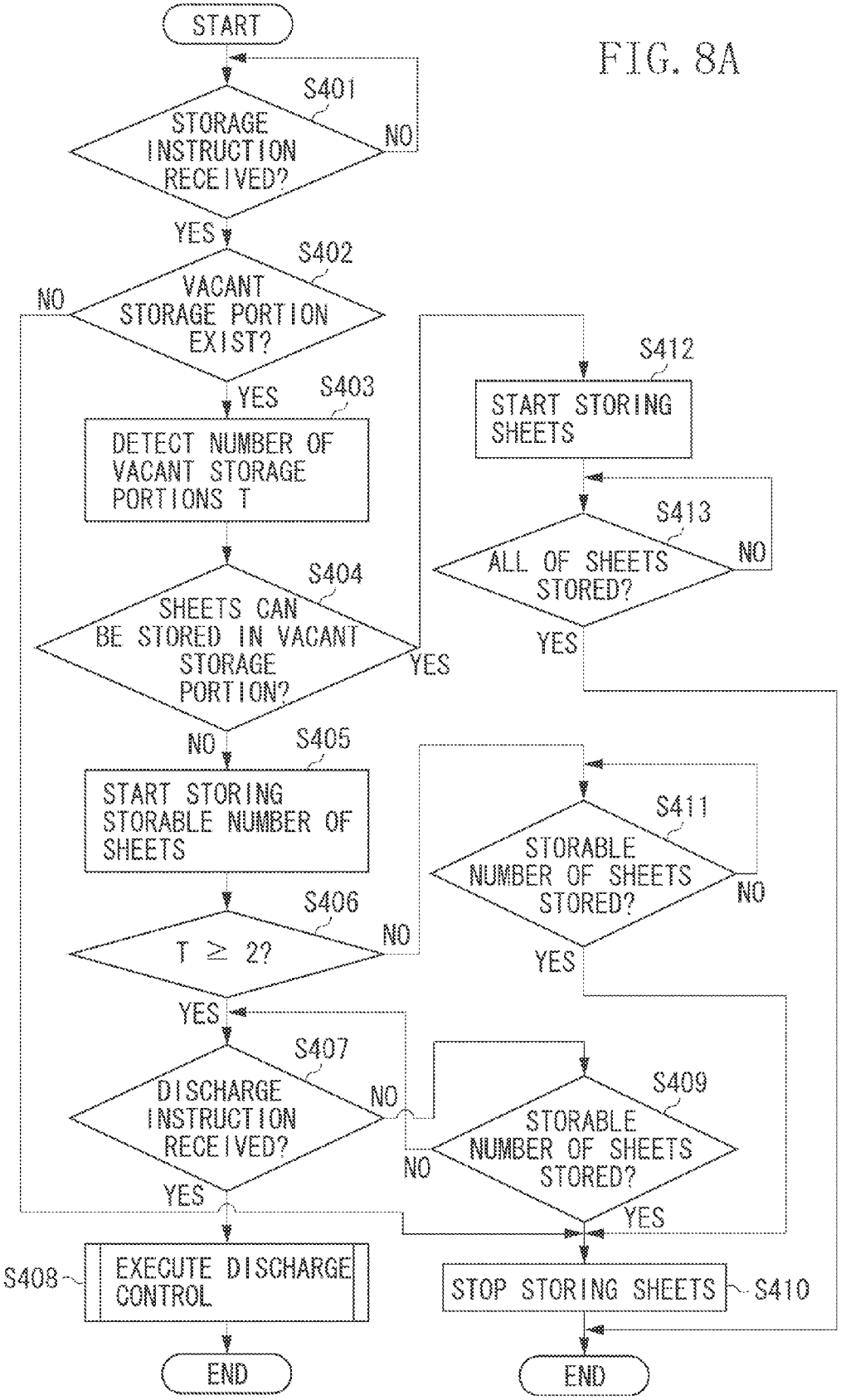
FIGS. 8A and 8B are flowcharts according to the exemplary embodiment.
Figure 8B:
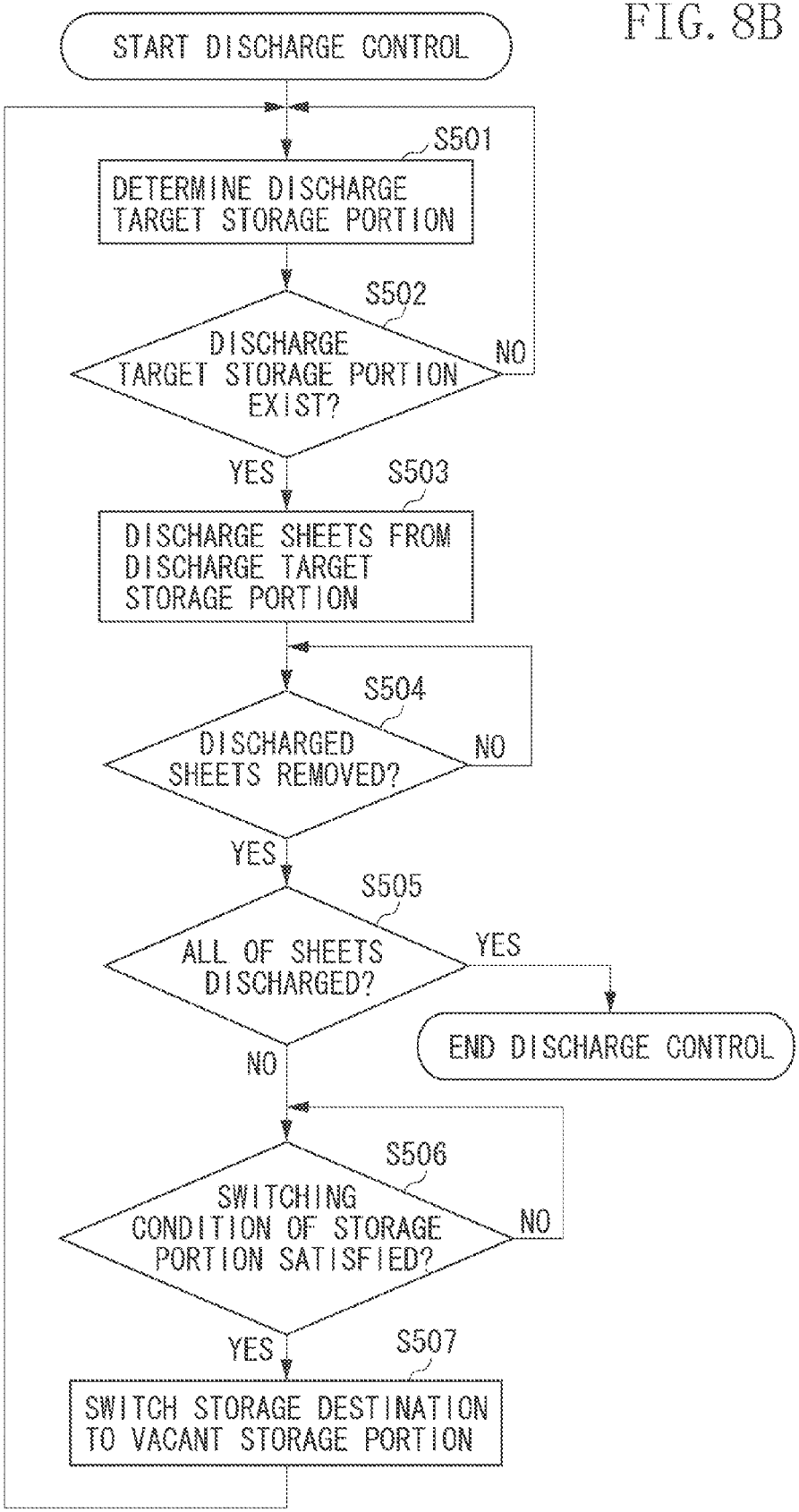

A control method of the above-described image forming apparatus 100 will be described. In the present exemplary embodiment, description will be given of the control processing that is to be executed when the user has formed images on a number of the sheets S more than storable in a plurality of vacant storage portions, and gives an instruction for storing the number of sheets S in the storage portions. In such a case, when the user gives a discharge instruction of the sheets S while the sheets S are being stored in the storage portion, the image forming processing and the processing for storing the sheets S in the storage portions can be continued sequentially. When the image forming processing and the processing for storing the sheets S in the storage portions are continued sequentially, the image forming operation with respect to the sheets S executed by the image forming unit 101 and the conveyance operation of the sheets S with respect to the storage portions executed by the conveyance unit 105 are continued without being stopped temporarily. FIGS. 8A and 8B are flowcharts according to the present exemplary embodiment. The control processing based on these flowcharts will be executed by the controller 302 described in FIG. 4 based on a program stored in the memory 305.

The flowchart in FIG. 8A mainly relates to the control processing for storing the sheets S in the storage device 200. First, in step S401, the controller 302 determines whether the user gives a storage instruction of the sheets S. When the user gives an instruction for storing the sheets S on which images are formed in the storage device 200 through the external device 300 (YES in step S401), the processing proceeds to step S402. In step S402, the controller 302 determines whether any vacant storage portion exists by checking through the sheet presence-absence sensors 231 to 233. If the vacant storage portion does not exist and the sheet S cannot be stored in the storage device 200 (NO in step S402), the controller 302 ends the flowchart. If the vacant storage portion exists (YES in step S402), the processing proceeds to step S403. In step S403, the controller 302 detects the number of vacant storage portions "T". Then, the controller calculates the number of sheets S "C1" to be stored, and the number of sheets S "C2" currently storable in the storage device 200. In the present exemplary embodiment, "C2" can be calculated from the number of vacant storage portions and the maximum number of sheets S storable in the storage portion stored in the memory 305. In the present exemplary embodiment, because the maximum number of sheets S storable in one storage portion is 10, "C2" can be calculated by a formula C2=T×10. In step S404, the controller 302 compares the values "C1" and "C2", and determines whether all the sheets S can be stored in the vacant storage portions. If the controller 302 determines that all the sheets S can be stored therein, for example, when "C1" is 15 whereas "C2" is 20, (YES in step S404), the processing proceeds to step S412. In step S412, the conveyance unit 105 conveys the sheets S to the vacant storage portions sequentially. Then, in step S413, the controller 302 waits until it is determined that all the sheets S are stored in the storage portions. If the controller 302 determines that all the sheets S cannot be stored therein, for example, when "C1" is 25 whereas "C2" is 20, (NO in step S404), the processing proceeds to step S405. In step S405, the conveyance unit 105 starts conveying the sheets S storable in the storage device 200 to the vacant storage portions. Next, in step S406, the controller 302 determines whether the value "T" detected in step S403 is equal to or greater than 2. In other words, the controller 302 determines whether more than one storage portions are vacant. If only one storage portion is vacant (NO in step S406), the processing proceeds to step S411, because the image forming processing and the processing for storing the sheets S in the storage portion cannot be continued sequentially even if the user gives a discharge instruction of the sheets S while the sheets S are being stored therein. Therefore, in step S411, when it is determined that the sheets S storable in one vacant storage portion have been conveyed thereto (YES in step S411), the processing proceeds to step S410. In step S410, the conveyance unit 105 stops the storing operation of the sheets S. If more than one storage portions are vacant (YES in step S406), when the user gives a discharge instruction of the sheets S while the sheets S are being stored, the image forming processing and the processing for storing the sheets S in the storage portion can be continued sequentially. Therefore, in step S407, the controller 302 determines whether the discharge instruction is provided from the user before the storable sheets S are stored in the storage device 200 in step S409. If the discharge instruction is provided (YES in step S407), the processing proceeds to step S408. In step S408, the controller 302 executes the discharge control illustrated in FIG. 8B. If the discharge instruction is not given (NO in step S407), and the storable sheets S have been stored in the storage device 200 (YES in step S409), the processing proceeds to step S410. In step S410, the conveyance unit 105 stops the storing operation of the sheets S.

Next, discharge control to be executed when a discharge instruction from the user is received while the sheets S are being stored will be described with reference to the flowchart of FIG. 8B. When the user gives a discharge instruction of the sheets S stored in the storage portion through the external device 300 or the operation unit 307, in step S501, the controller 302 designates a discharge target storage portion. In order to designate the discharge target storage portion, the controller 302 perceives the current storage state of the sheets S stored in the storage device 200. The storage state may be the presence or absence of the sheets S stored in the storage portions 201 to 203, or the number of stored sheets S. As to whether the sheets S are stored in the storage portions 201 to 203 can be detected by the sheet presence-absence sensors 231 to 233. Further, the number of sheets S currently stored in the storage portions 201 to 203 is stored in the memory 305, and the number thereof is sequentially counted whenever the image forming processing is executed. When the discharge processing of the sheets S is executed, the number of stored sheets S stored in the memory 305 is cleared. After perceiving the above-described storage state of the sheets S, the controller 302 designates a storage portion storing a maximum number of the sheets S as a discharge target. In other words, a fully-storing storage portion is designated as a discharge target. A vacant storage portion that stores no sheets S, or a storage portion which still can store more sheets S is not designated as a discharge target. However, if all the sheets S are stored and the sheets S to be stored are not left, the storage portion is designated as a discharge target even if that storage portion has not fully stored the sheets S. If the discharge target storage portion does not exist (NO in step S502), the controller 302 executes the processing in step 501 again, and waits until the discharge target storage portion is designated. If the discharge target storage portion exists (YES in step S502), the processing proceeds to step S503. In step S503, the controller 302 instructs the storage device control unit 304 to discharge the sheets S stored in the discharge target storage portion, so that the moving unit exposes a part of the sheets S from the opening 250. In step S504, based on a detection result of the opening sensor 236 acquired through the storage device control unit 304, the controller 302 determines whether the discharged sheets S are removed. The storage device control unit 304 determines that the sheets S are removed when the opening sensor 236 changes from the ON state to the OFF state. If the sheets S are removed (YES in step S504), the processing proceeds to step S505. In step S505, the controller 302 determines whether all the sheets S are discharged. If all the sheets are discharged (YES in step S505), the controller 302 ends the processing of this flowchart. On the other hand, if the controller 302 determines that the sheets S to be discharged still exists (NO in step S505), the processing proceeds to step S506. In step S506, the controller 302 determines whether the switching condition of the storage portion is satisfied. Similar to the discharge target condition of the storage portion described in step S501, the switching condition of the storage portion is determined based on whether the storage portion to which the sheets S are being conveyed is fully stores sheets S. In step S506, the controller 302 waits until the storage portion stores the sheets S to satisfy the switching condition of the storage portion. In a case where the switching condition of the storage portion is satisfied (YES in step S506), the processing proceeds to step S507. In step S507, the controller 302 switches the storage destination to a vacant storage portion from which the sheets S have been discharged. However, in a case where all the sheets S have been stored and sheets S to be further stored do not exist, the processing proceeds to the next step (S507) even if the storage portion has not fully stored the sheets S.

Figure 9A:
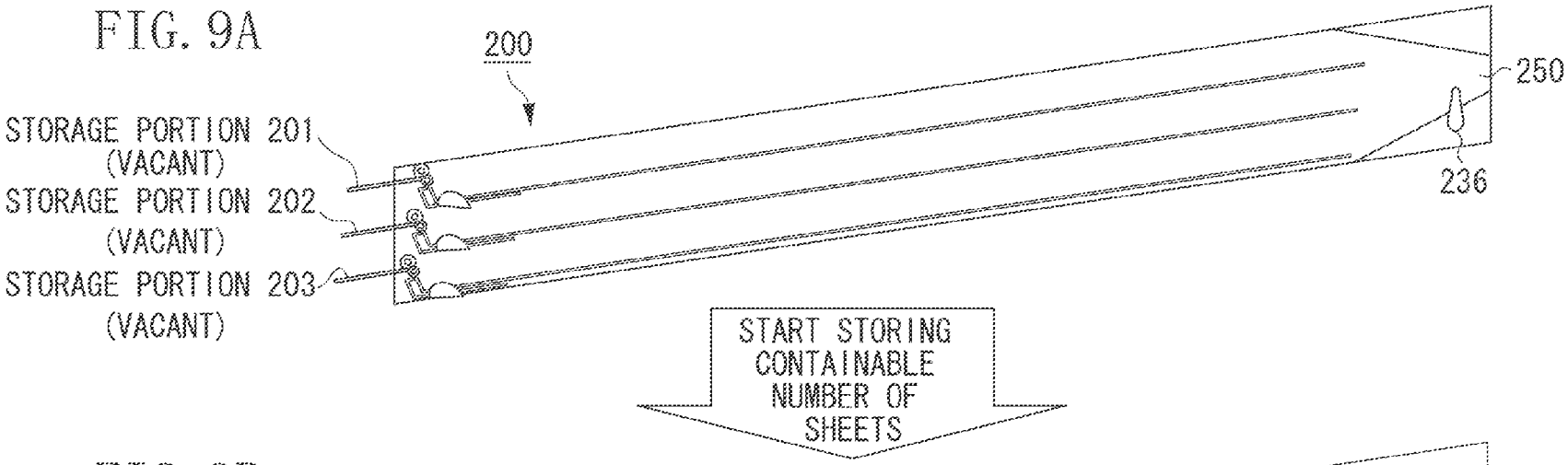
FIGS. 9A to 9F are diagrams illustrating specific examples to which the exemplary embodiment is applied.
Figure 9B:
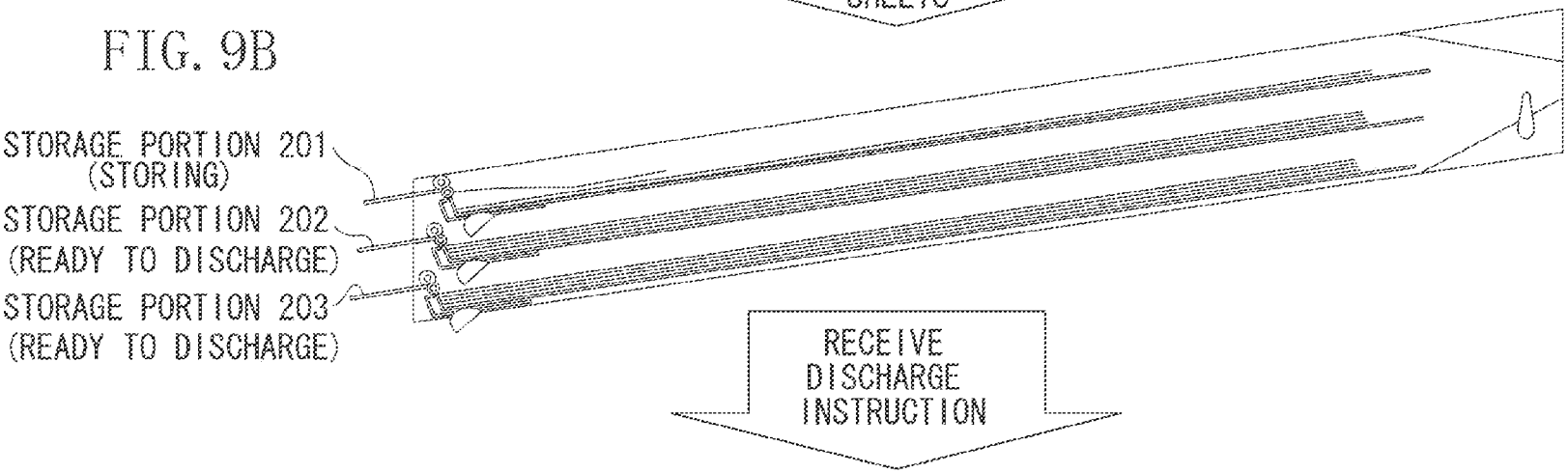
Figures 9C, 9D:
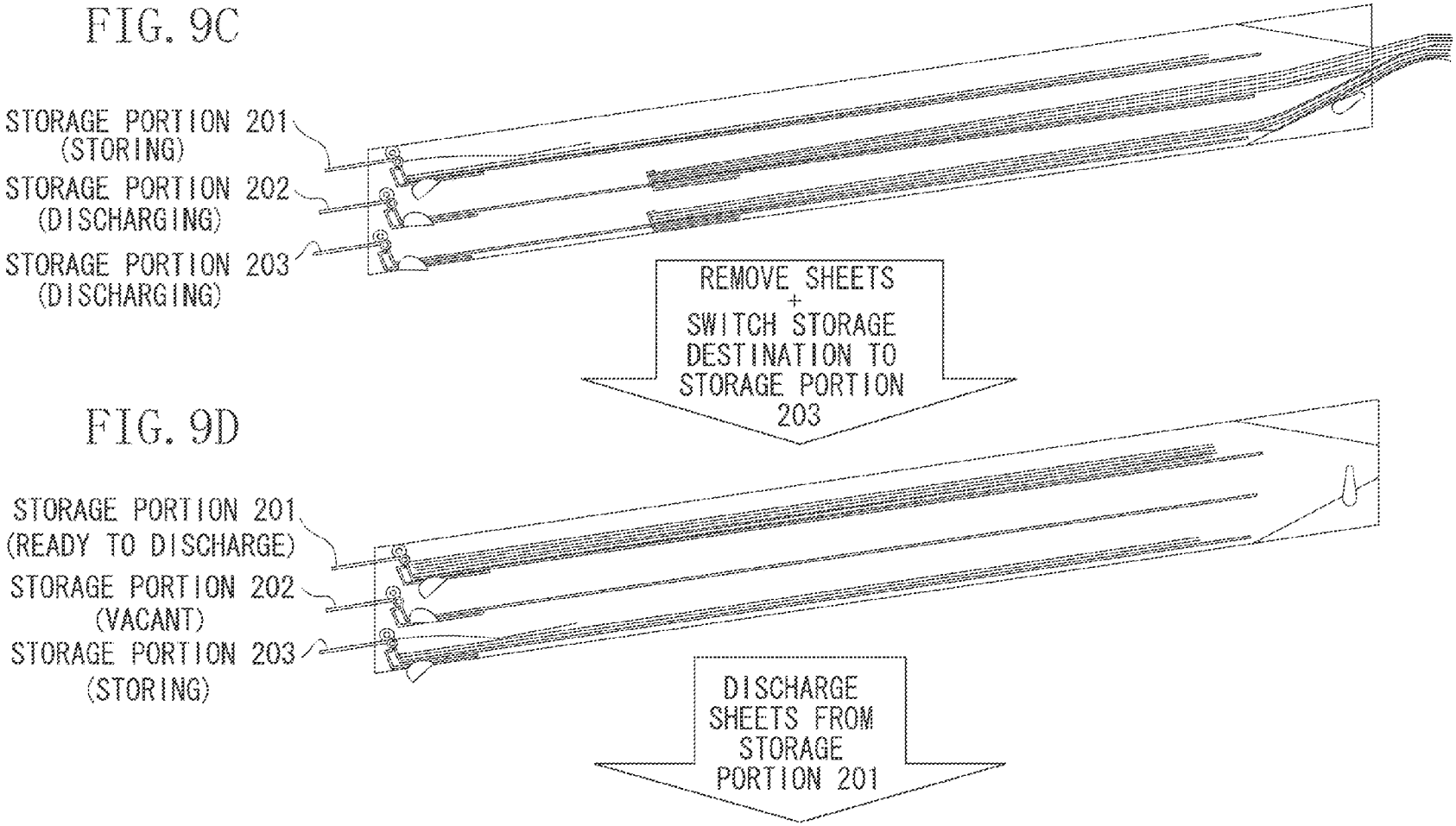
Figures 9E, 9F:
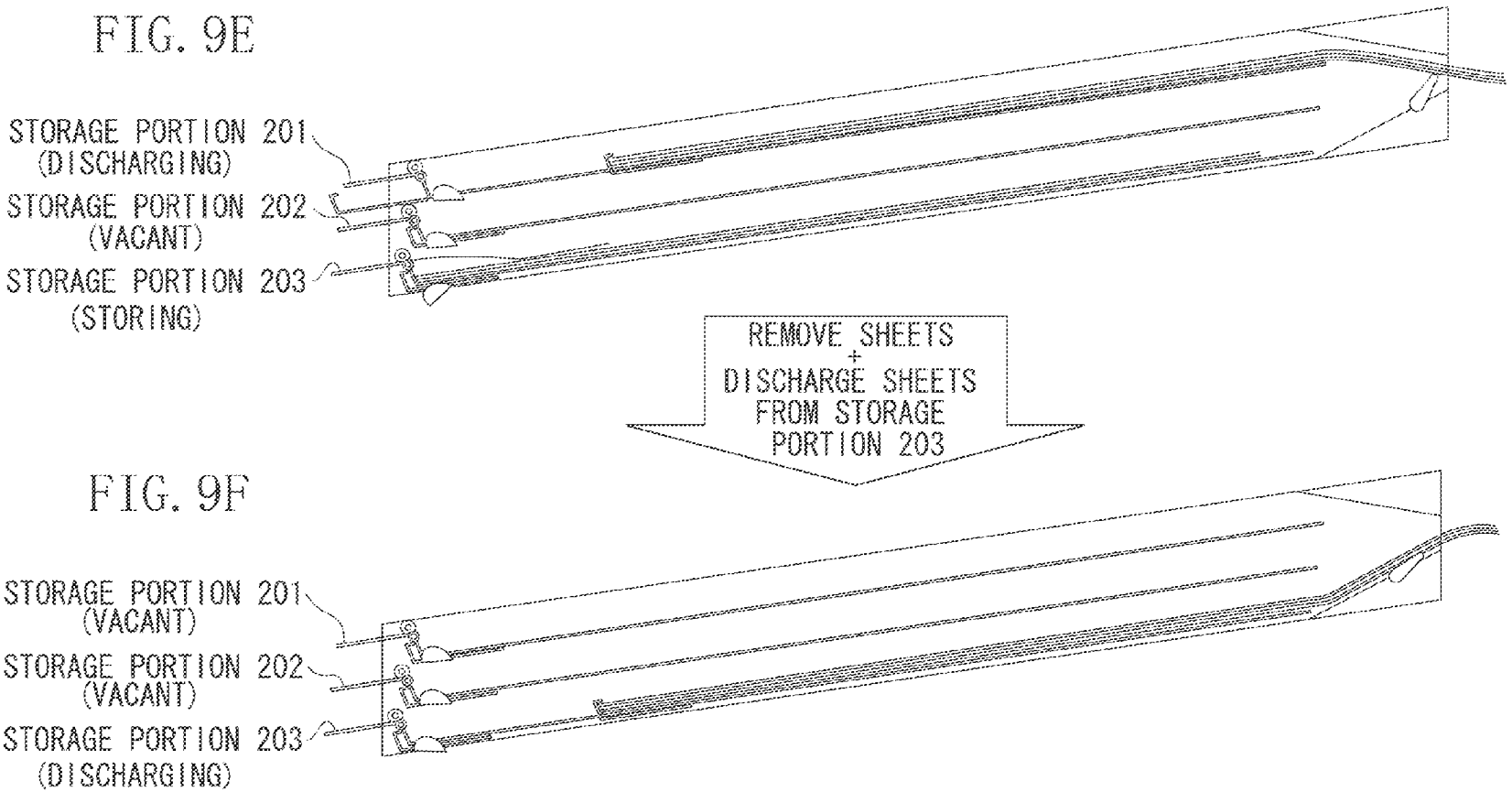

The specific examples thereof are illustrated in FIGS. 9A to 9F. In FIG. 9A, the storage device 200 includes three storage portions 201 to 203, and all the storage portions 201 to 203 are not full. Each of the storage portions 201 to 203 can store the number of sheets S up to ten (i.e., the maximum number of storable sheets S is 10). Therefore, in a state as illustrated in FIG. 9A, a total of thirty sheets S can be stored therein. At that time, assuming that the user gives an instruction for storing forty sheets S in the storage device 200. Although the number of sheets S to be stored (40 sheets) is greater than the number of sheets S storable in the storage device 200 (30 sheets), the conveyance unit 105 starts conveying the sheets S to the storage portions 201 to 203. Then, as illustrated in FIG. 9B, the conveyance unit 105 conveys ten sheets S to each of the storage portions 202 and 203, and if the user gives a discharge instruction at the timing at which the sheets S are being conveyed to the storage portion 201, the controller 302 determines a discharge target storage portion. Since the storage portions 202 and 203 are full, both the storage portions 202 and 203 are determined as discharge targets. Therefore, as illustrated in FIG. 9C, the moving units 242 and 243 move from the stacking positions to the exposing positions, so as to expose the sheets S stored in the storage portions 202 and 203 to the exterior of the apparatus from the opening 250. At that time, the conveyance unit 105 conveys the sheets S to the storage portion 201 continuously. When the opening sensor 236 changes from the ON state to the OFF state to detect that the bundle of the sheets S is removed, then the moving units 242 and 243 move from the exposing positions to the stacking positions. Further, when the sheet presence-absence sensors 232 and 233 detect that the sheets S are not stacked, the storage portions 202 and 203 are ready to store new sheets S. FIG. 9D illustrates a state where the storage destination of the sheets S is switched to the vacant storage portion 203 after the ten sheets S are stored in the storage portion 201. As illustrated in FIG. 9E, because the storage portion 201 is full and ready to discharge the sheets S, the moving unit 241 moves from the stacking position to the exposing position, so as to expose the sheets S stored in the storage portion 201 to the exterior of the apparatus from the opening 250. At that time, the conveyance unit 105 conveys the sheets S to the storage portion 203 continuously. FIG. 9F illustrates a state where the remaining ten sheets S are stored in the storage portion 203 and exposed to the exterior of the apparatus.

In FIG. 9A, description has been given of the case where all the storage portions 201 to 203 are vacant at the time when the storing operation of the sheets S is started. However, for example, in a case where other user's sheets S are stored in the storage portion 201 at that point in time, the storage portion 201 cannot be used. Therefore, the number of sheets S storable at that time will be twenty. In such a case, the above-described control method is applicable to the case where the sheets S the number of which is greater than twenty are conveyed.

With the above-described control method, the user can intentionally make a vacant storage portion by removing the sheets S from the full state storage portion. Then, by switching the storage destination of the sheets S to that vacant storage portion, the image forming operation with respect to the sheets S and the storing operation with respect to the storage portion can be continued sequentially without depending on the capacity of the storage device 200 (i.e., the number of storable sheets S).

Further, in the specific examples of FIGS. 9E and 9F, the sheets S have been discharged from the storage portion designated as a discharge target immediately after the storage destination of the sheets S is switched to other storage portion. However, if the user would like to collectively discharge the sheets S as much as possible, that discharge target storage portion may wait until the other storage portion is designated as a discharge target. In other words, in the specific example of FIG. 9E, instead of simply discharging the sheets S from the storage portion 201, the storage portion 201 waits until the storage portion 203 in which the sheets S are being stored is also designated as a discharge target. Thus, when the storage portion 203 becomes full and designated as a discharge target, the sheets S are collectively discharged from the storage portions 201 and 203. Furthermore, in the specific example of FIG. 9A, the user has given an instruction for storing forty sheets S. However, in a case where the user has provided an instruction for storing the sheets S more than forty but less than fifty, the storage portion 201 waits until the storage portion 202 is also designated as a discharge target. Then, when the storage portion 202 also becomes full and designated as a discharge target, the sheets S are collectively discharged from the storage portions 201 to 203. Furthermore, the user can previously specify whether to prioritize the operation for collectively discharging the sheets S stored in a plurality of the storage portions through the operation unit 307 provided on the image forming apparatus 100 or through the external device 300.

Furthermore, in the present exemplary embodiment, the maximum number of sheets S storable in each of the storage portions 201 to 203 stored in the memory 305 is fixed to ten. However, this maximum number thereof may be changed according to the thickness of the sheet S. A sensor that detects an amount of transmitted light by irradiating the sheet S with light is provided as a sensor for detecting the thickness of the sheet S. Further, in order to acquire information relating to the thickness, a sensor that detects grammage (i.e., weight per square meter (unit: $g/m^2$)) of the sheet S may be also employed. An ultrasonic sensor is known as a sensor for detecting the grammage. With the ultrasonic sensor, the grammage can be detected by emitting an ultrasonic wave to the sheet S and receiving an attenuated ultrasonic wave via the sheet S. Thus, the maximum number of storable sheets may be dynamically changed by disposing the above-described sensors on the conveyance path of the sheet S. Furthermore, the information such as the thickness or the grammage of the sheet S can be also acquired from a sheet type (i.e., a thick paper, a standard paper, or a thin paper) specified by the user when a printing instruction is provided.

Further, in the present exemplary embodiment, a condition for designating a storage portion as a discharge target, and a condition for switching a conveyance destination of the sheets S have been determined based on whether the storage portion has become full. However, the storage portion does not have to be full, and the storage portion storing a number of the sheets S equal to or greater than a predetermined threshold value may be designated as a discharge target. Similarly, the conveyance destination of the sheets S may be switched to the other storage portion when the number of sheets S stored in the storage portion to which the sheets S are being conveyed has reached the predetermined threshold value.

As described above, description has been given to the exemplary embodiment which enables the image forming operation with respect to the sheet S and the storing operation with respect to the storage portion to be continued sequentially in a case where the user gives a discharge instruction before the storable sheets S are stored in the storage device 200. In another embodiment, the user provides a discharge instruction after the storable sheets S are stored in the storage device 200. In this case, because the storing operation of the sheets S with respect to the storage device 200 is stopped, the image forming operation with respect to the sheets S and the storing operation with respect to the storage portion cannot be continued sequentially. However, the image forming operation with respect to the sheets S and the storing operation with respect to the storage portion can be executed continuously again.

Description will be given to a case where the controller 302 receives a discharge instruction from the user when the storable sheets S have been already stored in the storage device 200 and the operation for storing the sheets S is stopped (as illustrated in step S410 of FIG. 8A). At that time, the controller 302 discharges the sheets S from the storage portion in which the sheets S are stored. Then, based on the detection result of the opening sensor 236, when the controller 302 detects that the sheets S exposed from the opening 250 are removed, the controller 302 moves the corresponding moving unit disposed on that storage portion to the stacking position from the exposing position. Further, based on the detection result of the corresponding sheet presence-absence sensor disposed on the storage portion, when the controller 302 detects that the sheets S are not stored in the storage portion, the controller 302 conveys the remaining portion of the sheets S to that vacant storage portion. With this operation, after stopping the image forming operation with respect to the sheets S and the storing operation with respect to the storage portion temporarily, the operations thereof can be restarted by the instruction from the user. Accordingly, the image forming operation with respect to the sheets S and the storing operation with respect to the storage portion can be executed continuously again.

In the above-described exemplary embodiment, because the moving units of the respective storage portions are provided with separate actuators, the sheets stored in a plurality of the storage portions can be stacked and exposed by concurrently driving these actuators. On the other hand, for example, a drive transmission switching unit such as a clutch (not illustrated) may be provided together with the actuators the number of which is less than that of storage portions. With this configuration, the plurality of moving units can be selectively moved by a single actuator.

In addition, in the above-described exemplary embodiment, the memory 305 is included in the controller 302. However, the memory 305 may be provided on the engine control unit 303 or the storage device control unit 304, or maybe independently disposed within the image forming apparatus control unit 301.

Further, in the above-described exemplary embodiment, the engine control unit 303 and the storage device control unit 304 have been configured separately. However, the engine control unit 303 and the storage device control unit 304 may be configured integrally. In such a case, the engine control unit 303 may control the conveyance unit 105 and the storage device 200.

Furthermore, in the above-described exemplary embodiment, a configuration having a single opening while the sheet conveyance paths are joined together on the downstream side of the storage portions has been described. However, a plurality of the openings may be disposed separately. Then, the sheets stored in each of the storage portions can be separately exposed from the openings.

In addition, in the above-described exemplary embodiment, a configuration having three storage portions has been described. However, the number of storage portions is not limited to three. The number of storage portions can be set according to the environment where the apparatus main unit is used, the number of users who share the apparatus main unit, or the specification of the apparatus main unit.

Further, in the above-described exemplary embodiment, the storage device 200 and the image forming apparatus 100 have been configured integrally. However, the storage device 200 may be detachably provided on the image forming apparatus 100. In such a case, a control unit disposed on the image forming apparatus 100 may control the operation of the storage device 200. Furthermore, an independent control unit may be disposed on the storage device 200 to control the operation thereof by communicating with the control unit provided on the image forming apparatus 100.

In addition, in the above-described exemplary embodiment, a laser beam printer has been described as an example. Reference to the image forming apparatus as a laser beam printer was provided for description purposes only, and any printer employing other printing methods such as an ink jet printer, or a copying machine, are applicable.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-191853 filed Sep. 17, 2013 and No. 2014-150777 filed Jul. 24, 2014, which are hereby incorporated by reference herein in their entirety.

What is claimed is:

1. An image forming apparatus comprising:

a main body formed with an opening;

a storage portion configured to store a sheet, on which an image is formed, inside the main body;

a conveyance unit configured to convey the sheet, on which the image is formed, to the storage portion;

a moving unit configured to move the sheet stored in the storage portion and stop the sheet in an exposed state in which a part of the sheet is exposed outside the main body through the opening; and a detection unit configured to detect the sheet in the exposed state, wherein, in a case where the image forming apparatus receives a first instruction to convey a first number of sheets, which is more than a storable number in the storage portion, to the storage portion, the conveyance unit conveys a second number of sheets, which is equal to or less than the storable number in the storage portion, to the storage portion, and then in a case where the image forming apparatus receives a second instruction to take out the sheets stored in the storage portion, the moving unit moves the second number of sheets being stored in the storage portion, and stops the sheets in the exposed state and then in response to the detection unit detecting that the second number of sheets in the exposed state is taken out from the storage portion, even if the image forming apparatus doesn't receive any further instruction to convey sheets or further instruction to take out sheets, the conveyance unit and the moving unit repeats an operation to convey rest of the sheets other than the second number of sheets among the first number of sheets to the storage portion and to move the rest of the sheets being stored in the storage portion and stop the rest of the sheets in the exposed state.

2. The image forming apparatus according to claim 1, further comprising a plurality of storage portions, wherein, in a case where a number of sheets conveyed to the storage portion by the conveyance unit reaches a threshold value, the conveyance unit switches a conveyance destination of the sheets to a different storage portion.

3. The image forming apparatus according to claim 2, wherein, in a case where a storage portion storing the number of sheets corresponding to the threshold value exists at a time when the image forming apparatus receives the second instruction, the moving unit determines the storage portion storing the number of sheets corresponding to the threshold value as a discharge target, moves the sheets stored in the storage portion determined as a discharge target, and stops the sheets in the exposed state.

4. The image forming apparatus according to claim 2, wherein, in a case where a storage portion storing the number of sheets corresponding to the threshold value does not exist at a time when the image forming apparatus receives the second instruction, the conveyance unit continues to convey the sheets to a storage portion to which the sheets are being conveyed until the number of sheets stored in the storage portion reaches the threshold value, and when the number of sheets stored in the storage portion reaches the threshold value, the moving unit determines the storage portion as a discharge target, moves the sheets stored in the storage portion determined as the discharge target, and stops the sheets in the exposed state.

5. The image forming apparatus according to claim 2, wherein, in a case where the conveyance unit has conveyed all of the sheets to the plurality of storage portions, a storage portion in which the number of stored sheets has not reached the threshold value is also determined as a discharge target.

6. The image forming apparatus according to claim 2, wherein the threshold value is a maximum number of sheets storable in the storage portion.

7. The image forming apparatus according to claim 6, further comprising an acquisition unit configured to acquire information relating to a sheet thickness, wherein the maximum number of the sheets is set according to the information relating to the sheet thickness.

* * * * *